US006974155B2

(12) United States Patent
Milan

(10) Patent No.: US 6,974,155 B2
(45) Date of Patent: Dec. 13, 2005

(54) PORTABLE CHAIR SYSTEMS

(76) Inventor: Patrick Thomas Milan, 226 E. Conan St., Ely, MN (US) 55731

( * ) Notice: Subject to any disclaimer, the term of this patent is extended or adjusted under 35 U.S.C. 154(b) by 0 days.

(21) Appl. No.: 10/449,869

(22) Filed: May 30, 2003

(65) Prior Publication Data

US 2004/0090060 A1 May 13, 2004

Related U.S. Application Data

(60) Provisional application No. 60/385,241, filed on May 31, 2002.

(51) Int. Cl.[7] ..... A63C 11/00

(52) U.S. Cl. ..... 280/812; 297/217.1; 135/66

(58) Field of Search ..... 280/812, 809, 280/814, 816, 820; 297/217.1, 16.2; 224/155; 135/66

(56) References Cited

U.S. PATENT DOCUMENTS

| | | | | | |
|---|---|---|---|---|---|
| 2,122,347 | A | * | 6/1938 | Lasch | 297/118 |
| 2,547,073 | A | * | 4/1951 | Bueler | 280/812 |
| 3,838,883 | A | * | 10/1974 | Machen | 297/16.2 |
| 3,902,731 | A | * | 9/1975 | Fagen et al. | 280/812 |
| 4,065,140 | A | * | 12/1977 | Cadwalader | 280/812 |
| 4,456,284 | A | | 6/1984 | Saka | 280/812 |
| 4,494,796 | A | * | 1/1985 | Liebhold | 297/440.24 |
| 4,583,778 | A | * | 4/1986 | Liebhold | 297/56 |
| 4,720,029 | A | * | 1/1988 | Varanakis | 224/155 |
| 4,762,339 | A | | 8/1988 | Hoek | 280/812 |
| 4,786,082 | A | | 11/1988 | Swietlik | 280/812 |
| 4,925,064 | A | * | 5/1990 | Comora | 224/155 |
| D325,303 | S | * | 4/1992 | Pettersson | D6/335 |
| 5,118,136 | A | * | 6/1992 | Johnson | 280/812 |
| 5,441,184 | A | * | 8/1995 | Durso | 224/577 |
| 5,718,473 | A | * | 2/1998 | Lynch, Jr. | 297/16.2 |
| 6,547,324 | B1 | * | 4/2003 | Ammann, Jr. | 297/129 |
| 2003/0020273 | A1 | * | 1/2003 | Rogers | 280/812 |

FOREIGN PATENT DOCUMENTS

| | | | | |
|---|---|---|---|---|
| DE | 656406 | | 8/1938 | |
| EP | 0320464 | A1 * | 6/1989 | 280/812 |
| EP | 000421936 | A2 * | 4/1991 | 280/812 |
| EP | 000434077 | A2 * | 6/1991 | 280/812 |
| FR | 2572297 | A1 * | 5/1986 | 280/812 |

* cited by examiner

*Primary Examiner*—Christopher P. Ellis
*Assistant Examiner*—Jeff Restifo
(74) *Attorney, Agent, or Firm*—Fredrickson & Byron, PA

(57) ABSTRACT

A chair made of supports such as skis, poles such as ski poles, a base strap assembly, a seat portion assembly and optionally a cross retainer. The seat is formed by first attaching two supports together at the tips by a fastener, the upward facing support tips pointing downward. The upward facing support tails are then connected to the top handles of the poles, while a sling type seat constructed from a flexible material, such as nylon, is connected to the supports using web straps. The ski poles, being in an upright crossed position, support the chair and are held in place by a bottom triangular strap assembly connecting the bottom tips of the ski poles to the tips of the skis.

12 Claims, 7 Drawing Sheets

PORTABLE CHAIR SYSTEMS

This application claims the benefit of U.S. provisional appl. No. 60/385,241, filed May 31, 2002.

FIELD OF THE INVENTION

The present invention relates generally to snow skiing accessories. More specifically, this invention relates to a portable chair constructed using ordinary skis, poles and the seat and strap system of the present invention which can be easily assembled, disassembled, conveniently stowed and carried by a skier while skiing.

BACKGROUND OF THE INVENTION

The concept of sitting on the side of the ski slope and resting has been around as long as the sport itself. Being able to rest on the slope is not only a pleasure but often is necessary, because of safety concerns. This is based on the probability for personal injury which greatly increases with increasing levels of fatigue. Having a comfortable ski chair system readily available would greatly increase the ability to take a well-deserved and needed rest before personal injury occurs.

Currently there is no ski chair system on the commercial market that is compact enough to carry while skiing. Backpacks having a fold down flap to allow one to sit on the snow have been used but provide no long-term comfort. Other efforts to provide a skier a temporary seat without sitting directly on the snow are embodied in the structures found in U.S. Pat. No. 4,786,082 wherein a seat is jointly supported by a pair of ski poles, U.S. Pat. No. 4,456,284 in which a temporary seat is formed in the nature of a sling suspended by a pair of sleeves supported by a ski pole upper end, and U.S. Pat. No. 4,762,339 in which a seat made from flexible material is supported by both skis and ski poles. These designs make for an extremely unstable configuration since the weight distributed by one sitting on the seat forces the skis and ski poles in opposite directions causing the seat to collapse and therefore not desirable to sit on. In addition to being unstable, these designs are limited by the location in which they can be used since one needs to insert the skis and ski poles into the snow in order to provide support.

Another type of ski chair is disclosed in German Pat. Reg. 656406. In this design the tips of the skis are pointed skyward and the tails used as the base support. A problem with the design disclosed in this patent is that the use of only one ski pole as a back support does not provide the adequate support needed for the weight of an average skier. The other ski pole is used to maintain the separation for the base support of the skis. This method does not create a comfortable nor a stable configuration for a seat.

Accordingly, it is the object of the present invention to provide a portable ski chair that can be carried by a skier, assembled, disassembled, stored and then carried when desired. Such a seat must be small and have minimum parts so that it can be easily transported and provide for an effortless assembly and disassembly.

SUMMARY OF THE INVENTION

The present invention provides a portable ski chair system that greatly increases the comfort level to the user. Generally, the ski chair system of the present invention is a portable chair system comprising a pair of supports such as skis, a pair of pole structures, a seat portion assembly, a base strap assembly and optionally, a cross point retainer. This self-supporting invention allows a chair to be set up virtually anywhere a regular chair can be placed.

In various embodiments of the present invention, a user may always have the chair available while skiing since the ski chair system of the present invention may include a backpack that is adjoined to the other components of the chair and may also operate as the seat portion of the ski chair. In other embodiments the ski chair system may be folded to fit into a backpack rather than having the backpack integrated into the chair system. Furthermore, in any embodiment of the present invention including a backpack, the backpack may be used to additionally carry other items, such as a First Aid kit, beverages, snacks, extra ski equipment or apparel, etc. Finally, the compact foldability of the ski chair system allows for more than one chair to be carried in a single backpack, thereby limiting the amount of excess baggage for groups of skiers.

The foregoing and additional advantages and characterizing features of the present invention will become increasingly apparent to those of ordinary skill in the art by references to the following detailed description and to the drawings.

DETAILED DESCRIPTION

Figure 1:
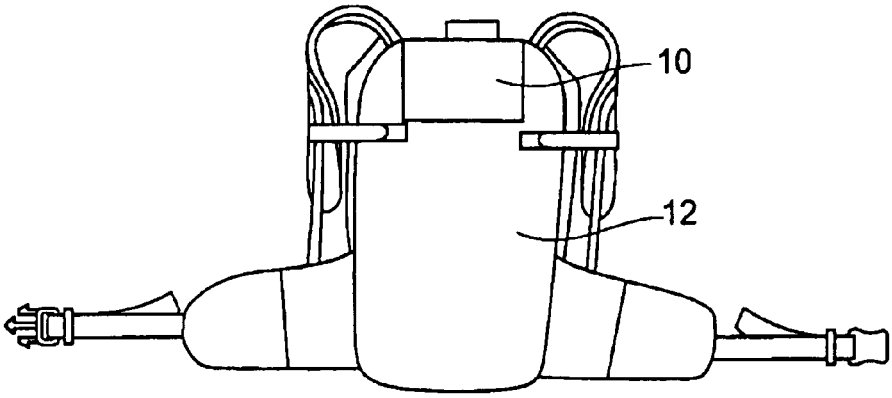
FIG. 1 depicts an embodiment the ski chair system of the present invention contained in a backpack.

The present invention relates to a portable chair system comprising a seat portion assembly, a base strap assembly, a pair of supports such as skis, a pair of pole structures and optionally, a cross point retainer. FIG. 1 depicts one embodiment of the seat portion assembly 10 wherein the majority of the seat portion assembly 10 is folded and conveniently contained in carrying means 12, such as a backpack. The carrying means 12 allows one to transport the ski chair system while skiing. When desiring to rest, the skier simply removes the carrying means 12 and places the system on a stable surface where it can be assembled into a chair.

Figure 2:
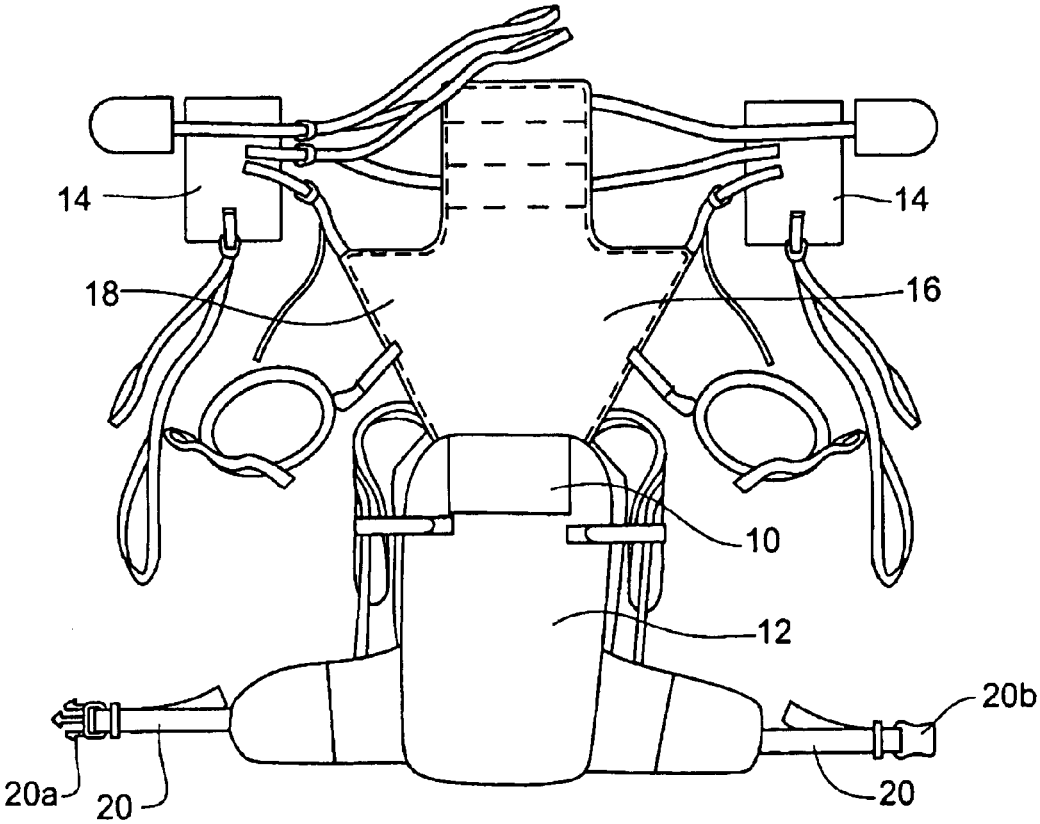
FIG. 2 depicts an embodiment of ski chair system of the present invention including an integrated backpack ready for assembly with skis and ski poles.

FIG. 2 depicts the seat portion assembly 10 wherein the assembly 10 is in an unpacked and unfolded arrangement. The seat portion assembly 10 of this embodiment includes a pole support assembly 14 operably adjoined to a seat portion 16. The seat portion 16 includes the backpack 12 and an upper backing 18. The seat portion assembly 16 of this embodiment further includes at least one lower seat attachment strap 20 or connection to at least one support (an example of the supports will be explained below) such as a ski. The lower seat attachment strap may be made of any suitable durable material such as nylon. It is noted that nylon or any other suitable textile may be utilized to manufacture the various components of the present invention. The lower seat attachment strap 20 is shown including an adjustable strap with male 20*a* and female 20*b* parts of a buckle to provide ease in adequately adjoining the seat portion assembly 10 to the supports (not shown).

Figure 3:
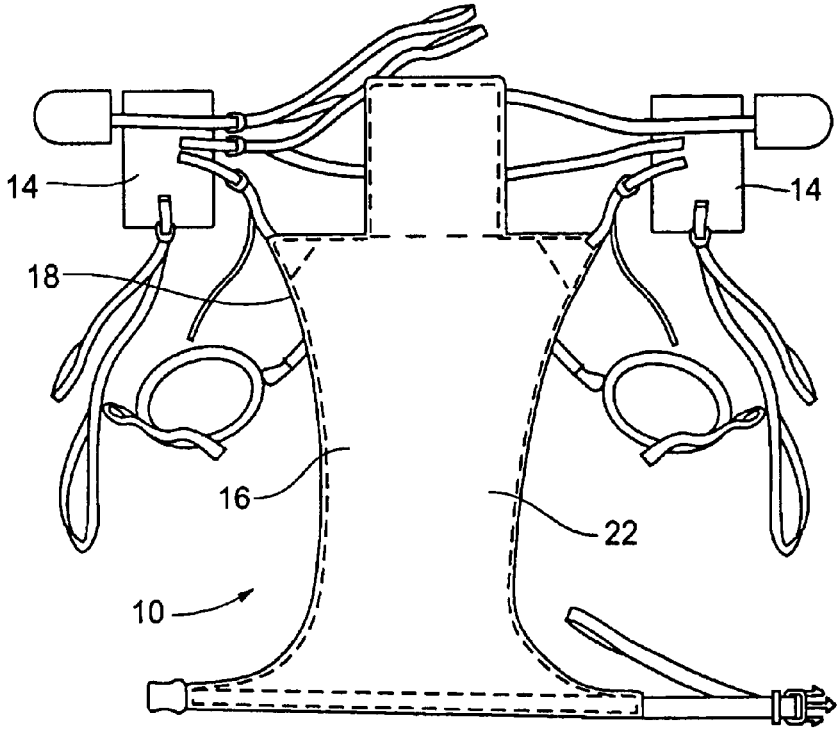
FIG. 3 depicts an embodiment of the ski chair system of the present invention including a seat portion for the chair, rather than a backpack, ready for assembly with skis and ski poles.

FIG. 3 depicts another embodiment with the seat portion assembly 10 wherein the seat portion 16 includes a seat base 22 rather than utilizing the backpack 12 and upper backing 18. The seat base may be manufactured from any semi-elastic durable material such as nylon or any other suitable textile. The removal of the back pack 12 allows for the seat portion assembly 10 to be folded into a compact configuration, thereby allowing multiple units to be transported in a single backpack.

Figure 4:
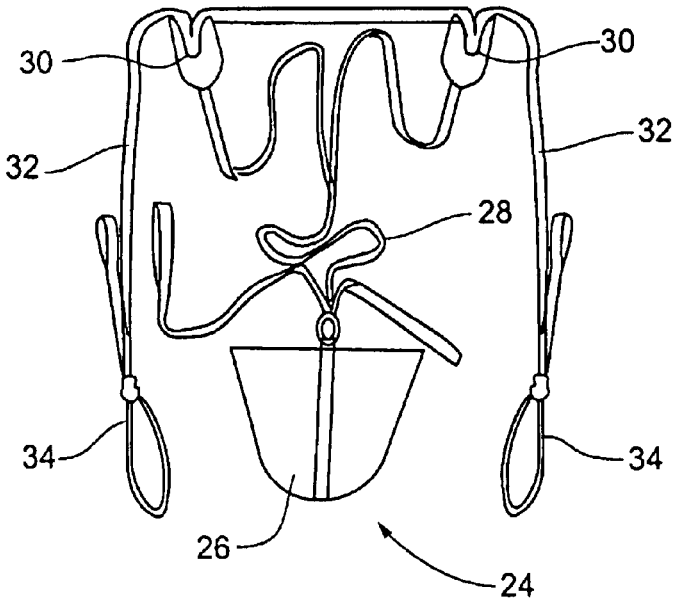
FIG. 4 depicts one embodiment of the base strap assembly of the present invention.

The portable chair system of the present invention further includes a base strap assembly 24 as depicted in FIG. 4. In one embodiment of the present invention, the base strap assembly 24 includes a support tips fastener 26 or ski tips fastener that is joined by one or more base straps 28 to a pair of pole structure tip retainers 30 or ski pole tip retainers. A pair of vertical ski pole straps 32 are attached to the pole structure tip retainers 30 for eventual attachment to one or more supports (not shown) by one or more support bindings 34, such as strap loops, which may be positioned at the ends of the ski pole straps 32. It is noted that in some embodiments of the present invention the base strap assembly 24 may integrally adjoined to the seat portion assembly 10 and/or the carrying means 12.

Referring now to FIGS. 5–9, assembly of one embodiment of the portable chair system of the present invention begins by unfolding and placing the seat portion assembly 10 on the ground. FIGS. 5–9 depict a seat portion assembly 10 having a seat portion 16 including a seat base 22 rather than a carrying means or backpack 12. However, either embodiment may be assembled in a similar fashion.

Figure 5:
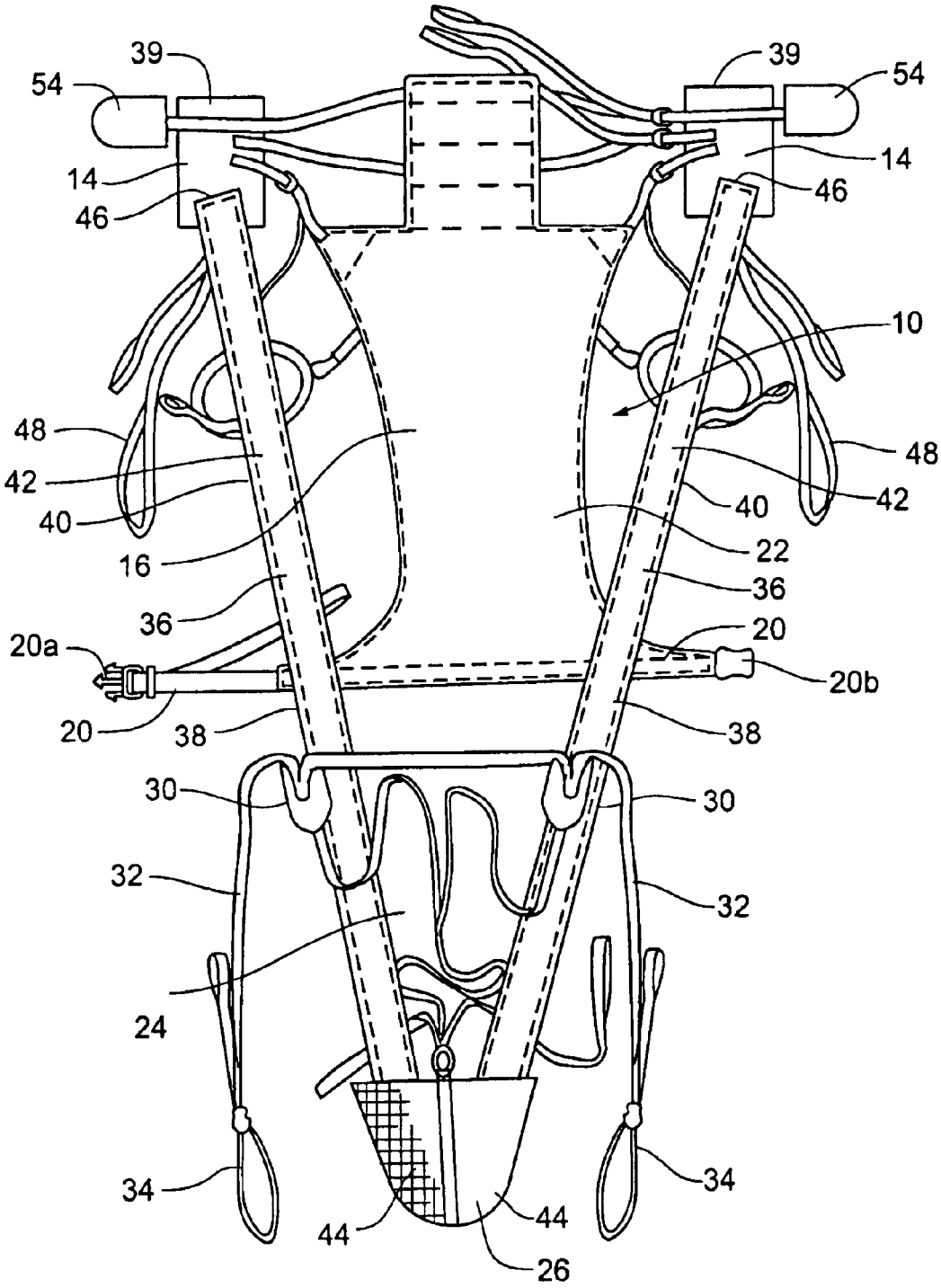
FIG. 5 is a top view of one embodiment of a partially assembled ski chair system of the present invention illustrating the adjoining of skis to the ski chair system.

FIG. 5 depicts an embodiment of the components of the portable chair system placed in approximate position before final assembly. First, the supports 36 (e.g. skis) are placed with the front and rear bindings 38 and 40 facing the ground so that the bottom side 42 of supports 36 is facing skyward. The support tips 44 are then inserted into the support tips fastener 26 and the vertical ski pole straps 32 are draped over the supports 36. The pair of supports or skis 36 form an acute angle and a V-shaped configuration when the tips 44 are placed near to each other.

Once the supports 36 are positioned into the support tip fastener 26 of the base strap assembly 24, the seat attachment 20, which is adjoined to the seat base 22 or backpack 12, is secured around the supports 36 by running the seat attachment male buckle 20*a*, and the female buckle 20*b* around each support 36 just in front of the front bindings 22 and attaching the female buckle 20*b* with the male buckle 20*a*. Next, a pair of support pockets 39 positioned on the pole support assembly 14 are slid over the support tails 46 of the supports 36. The support pockets 39 may be manufactured of any suitable material including nylon, plastic or any other durable material. The support retainer strap loops 48, which are operably attached to the pole support assembly 14 are then placed over the rear bindings 40 and tightened.

The pole handle ends 50 of a pair of pole structures 52 are inserted into two pole pockets 54 of the pole support assembly 14 and the poles 52 are crossed diagonally so that the pole tips 56 of each pole 52 are adjacent to and near an opposite support 36 and its corresponding front binding 38. By crossing the poles 52 in such fashion, the poles 52 will make a shape similar to the letter X. Each of the corresponding pole tips 56 are then inserted into the ski pole tip retainer 30 of the base strap assembly 24 near the front bindings 38.

Figure 6:
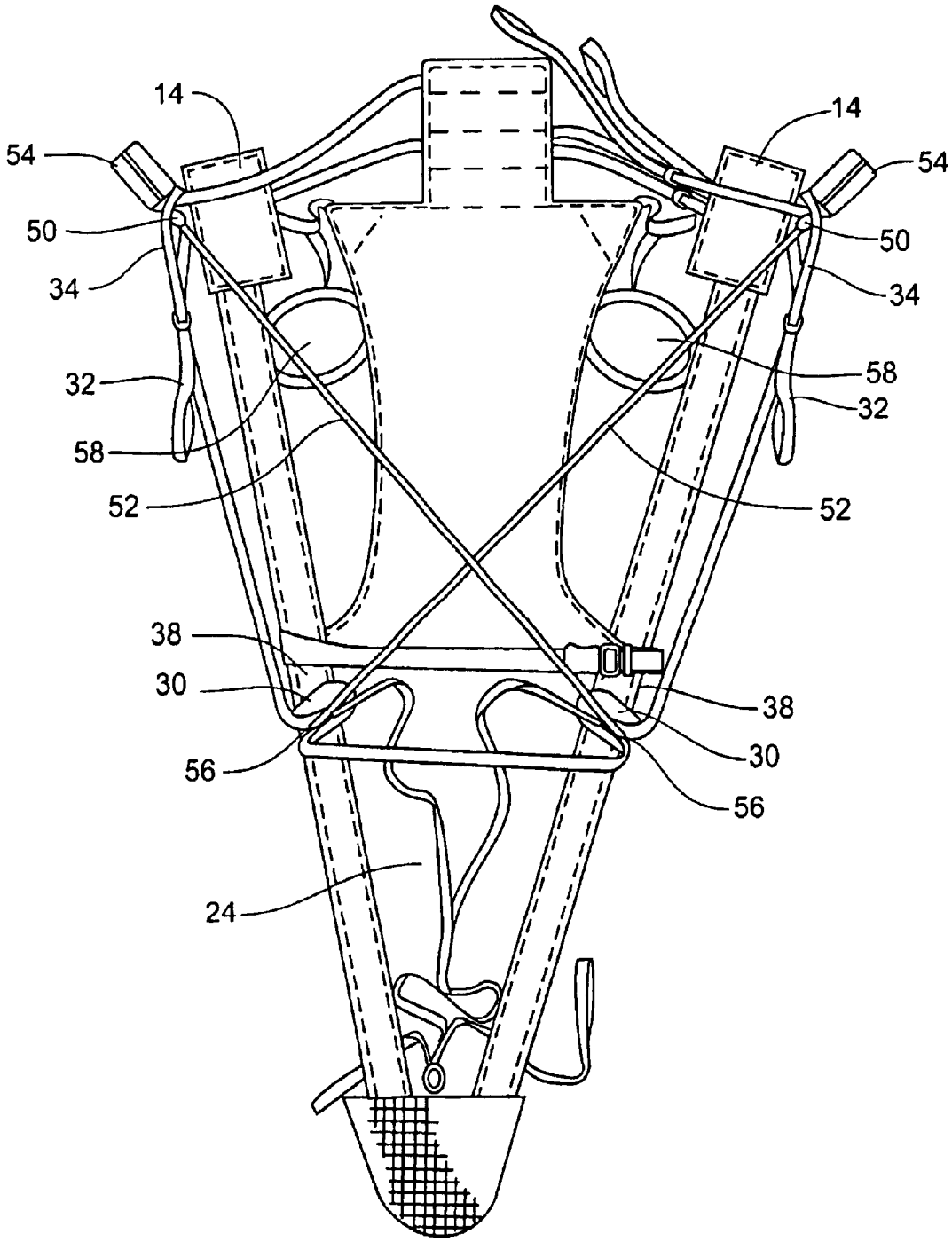
FIG. 6 depicts an embodiment of the present invention illustrating the attachment of the ski chair system to ski poles.

FIG. 6 shows an assembled portable chair system in a flattened configuration before final adjustments and placement into position. The vertical pole support straps 32 are then looped around the ski pole handles 50 within the pole pockets 54 of the pole support assembly 14. As previously indicated, the vertical support straps 32 are conjoined with the base strap assembly 24. Subsequently, the support straps 32 are evenly tightened. Also shown as an option are arm rests 58 attached to seat portion assembly 10 between the seat portion 16 and support retainer straps 48 from FIG. 5.

Figure 7:
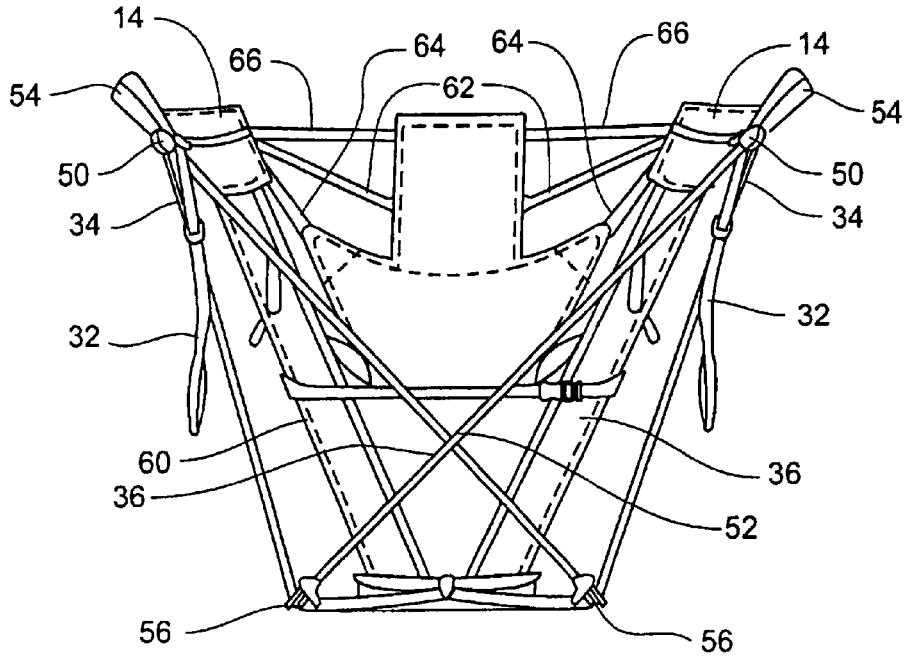
FIG. 7 is a rear view of an embodiment of an assembled ski chair system of the present invention.

FIG. 7 depicts a view from the rear of the invention. In order to add additional stability to the portable chair system a cross point retainer 60 may optionally be applied to the crossed poles 52. The cross point retainer 60 is generally wrapped around the poles 52 at the junction where the poles cross. The cross point retainer 60 may be any type of binding, such as a clip or strap.

Figure 8:
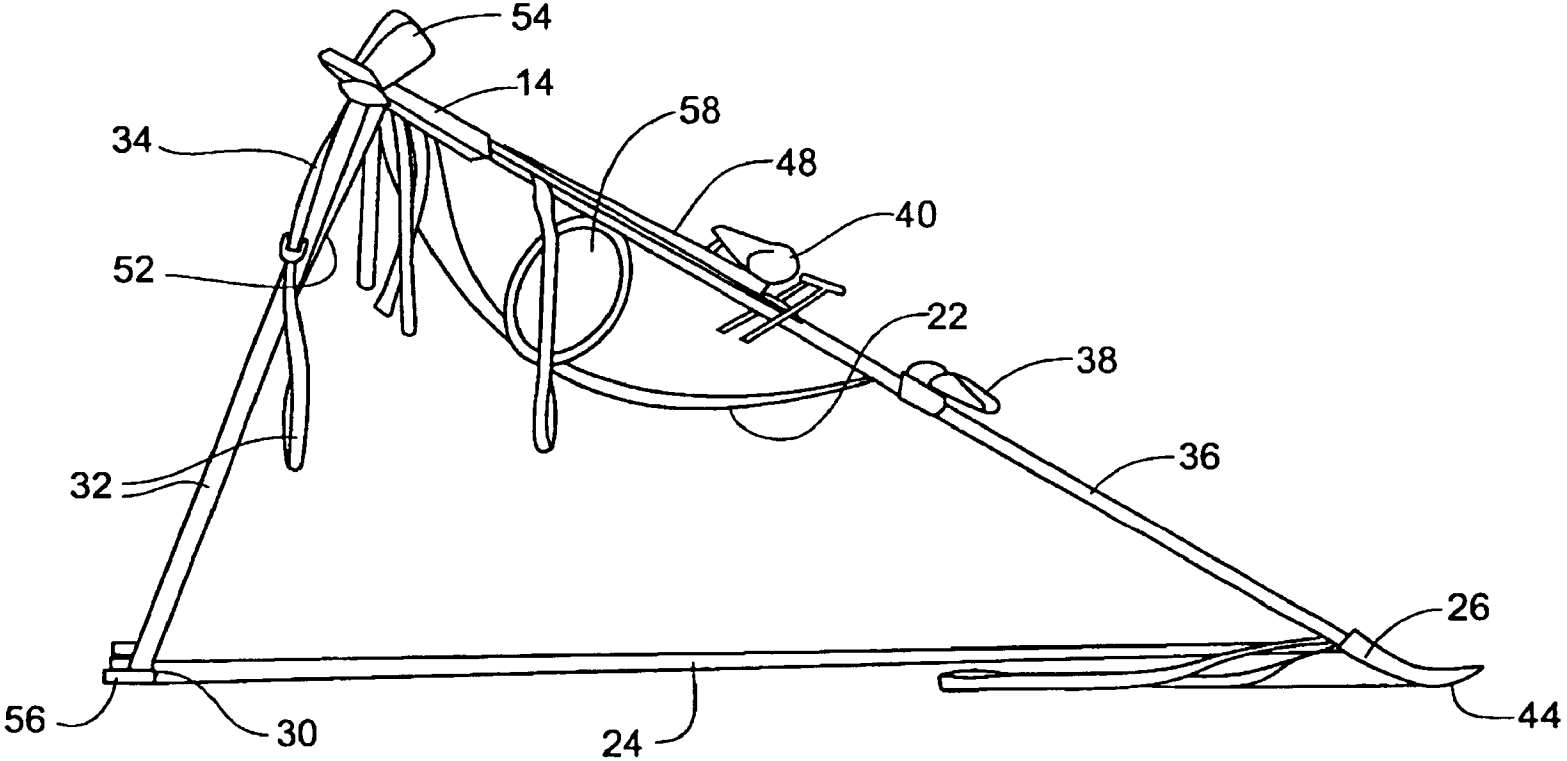
FIG. 8 is a side view of an embodiment of an assembled ski chair system of the present invention.

FIG. 8 shows a side view of the invention in a fully assembled, upright configuration. Proper adjustment is made for the length of the base strap assembly 24 to approximately attain a letter L shape when viewed from the side between the ski tips fastener 26, poles 52 and supports 36 while the poles tips 56 are pointing skyward and the supports 36 are lying flat on the ground. The ski chair system is then rotated 180 degrees such that the chair is resting on the tips of the skis 44 and the tips 56 of the ski poles, thereby placing it in a position to accommodate an person for sitting.

Figure 9:
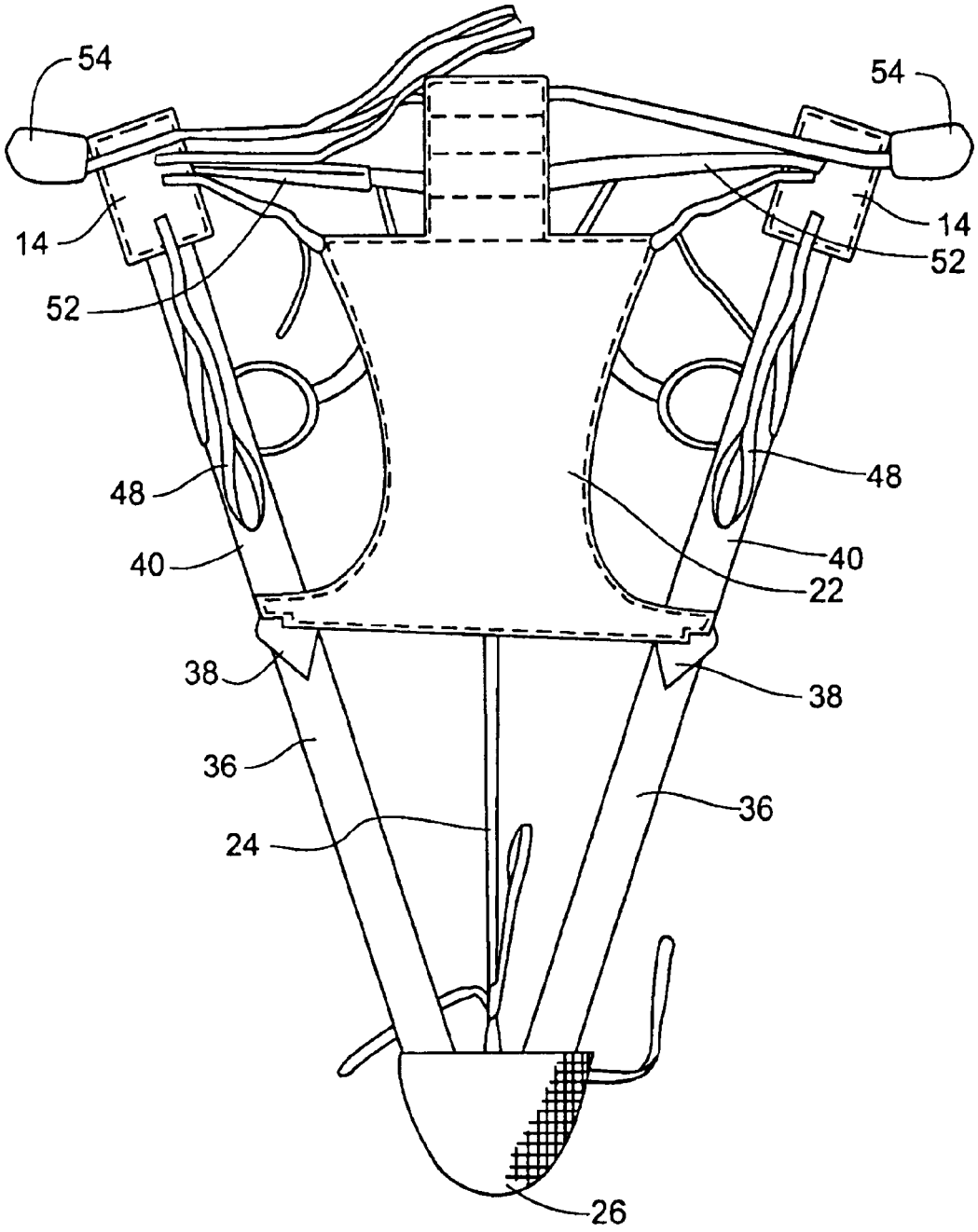
FIG. 9 is a top view of an embodiment of an assembled ski chair system of the present invention.

The next adjustment sequence contributes to the overall configuration of the chair and is depicted in FIGS. 8 and 9. First, both vertical pole straps 32 are tightened to attain a desired seat height. Next, the middle support straps 62 are tightened followed by the tightening of the upper support straps 64 then lower support straps 66. Finally, the cross point retainer 60 is attached. The cross point retainer may be comprised of a strap made of elastic binding material, that adjoins and secures the ski poles 52 in the position where they cross. The base strap assembly 24 near the ski tips 44 can be tightened or loosened in order to obtain a stable angle adjustment. An angle of about 2–45 degrees, preferably 5–35 should be achieved between the ski poles 52 and the ski tips 44, when viewed from the side. The arm rests 58 are optionally attached using a quick release buckle (not shown) adjoined to the retainer straps 48 and the seat portion 16. Once the maximum comfort position is achieved, the portable chair system is ready for use. FIG. 9 depicts an overhead view of the assembled portable chair system after final adjustments.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A portable chair system comprising:

(a) a pair of supports adjoined at the tips by a support tips fastener to form an angle;

(b) a pair of crossed pole structures;

(c) a seat portion assembly comprising a seat portion adjoined to a pole support assembly and a lower seat attachment, said pole support assembly and lower seat attachment being used to adjoin said seat portion to said pole structures and said supports; and (d) a base strap assembly comprising at least one base strap operably connected to the support tips fastener for adjoining said fastener to said pole structures and said supports, wherein the support tips adjoined by the support tips fastener and the crossed pole structure serve as the ground engaging elements of the portable chair system.

2. The system according to claim 1 further comprising a cross point retainer to securely fasten said pole structures in a stable configuration.

3. The system according to claim 1 where the supports are a pair of skis.

4. The system according to claim 1 where the pole structures are a pair of ski poles.

5. The system of claim 1 further comprising a carrying means to contain said seat portion assembly and said base strap assembly.

6. The portable chair system of claim 5 wherein said carrying means is in the form of a backpack.

7. The portable chair system of claim 1 further including a pair of arm rests.

8. A method of assembling a portable chair system comprising the steps of:

inserting two support tips from a pair of supports into a tip fastener to form an angle between the pairs of supports;

adjoining the supports to a pair of pole structure with a base strap assembly that includes said fastener;

inserting two support tails from the pair of supports into a seat portion assembly;

crossing said pole structures and attaching said pole structures to the supports with the seat portion assembly; and rotating said portable chair 180° to a sitting position such that the support tips inserted into the tip fastener and the pole structures serve as the ground engaging elements of the portable chair system.

9. The method of assembling a portable chair system according to claim 8 further comprising securing the position of said ski poles using a cross point retainer.

10. The method of assembling a portable chair system according to claim 8, wherein the supports are a pair of skis.

11. The method of assembling a portable chair system according to claim 8, wherein the pole structures are a pair of ski poles.

12. The method of assembling a portable chair system according to claim 8, wherein the base strap assembly and the seat portion assembly include adjustable straps.

* * * * *